US008946556B2

(12) United States Patent
Sunaga et al.

(10) Patent No.: US 8,946,556 B2
(45) Date of Patent: Feb. 3, 2015

(54) SHIELDED FLAT RIBBON CABLE AND METHOD FOR FABRICATING A SHIELDED FLAT RIBBON CABLE

(75) Inventors: Yoshinori Sunaga, Hitachinaka (JP); Takahiro Sugiyama, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 129 days.

(21) Appl. No.: 13/451,117

(22) Filed: Apr. 19, 2012

(65) Prior Publication Data

US 2012/0267143 A1 Oct. 25, 2012

(30) Foreign Application Priority Data

Apr. 21, 2011 (JP) ..... 2011-094716

(51) Int. Cl.

| | |
|---|---|
| ***H01B 9/02*** | (2006.01) |
| ***H01B 3/30*** | (2006.01) |
| ***H01B 7/00*** | (2006.01) |
| ***H01B 7/08*** | (2006.01) |
| ***H01R 43/00*** | (2006.01) |
| ***H01B 11/20*** | (2006.01) |

(52) U.S. Cl.

CPC ..... *H01B 11/203* (2013.01); *H01B 7/0861* (2013.01)

USPC ..... 174/106 R; 174/102 R; 174/110 R; 174/113 R; 174/117 F; 174/117 R; 29/868

(58) Field of Classification Search

CPC ... H01B 7/0861; H01B 7/0823; H01B 7/0018

USPC ..... 174/102 R, 106 R, 72 A, 113 R, 117 R, 174/117 F, 117 FF, 36, 105 R, 110 R; 29/868

See application file for complete search history.

(56) References Cited

U.S. PATENT DOCUMENTS 3,796,823 A * 3/1974 Wright et al. ..... 174/92
4,308,421 A * 12/1981 Bogese, II ..... 174/32

(Continued)

FOREIGN PATENT DOCUMENTS

JP 63-127018 8/1988
JP 2008-204805 A 9/2008

(Continued)

OTHER PUBLICATIONS

Notification of Reason(s) for Refusal dated Feb. 21, 2014, with English translation.

*Primary Examiner* — Timothy Thompson
*Assistant Examiner* — Sherman Ng
(74) *Attorney, Agent, or Firm* — McGinn IP Law Group, PLLC

(57) ABSTRACT

A shielded flat ribbon cable includes a plurality of insulated conductors being spaced parallel to each other, the insulated conductors each including an inner conductor and an insulation coating the inner conductor; an outer conductor bundling the insulated conductors together, the outer conductor including a first shell and a second shell in association with each other to sandwich the insulated conductors therebetween, each of the first shell and the second shell including a plurality of grooves covering outer surfaces of the insulated conductors, and a plurality of edge portions integral with both sides of the grooves, and gap formation-suppressing means for suppressing formation of gaps between the edge portions of the first shell and the edge portions of the second shell, respectively.

18 Claims, 6 Drawing Sheets

(56) References Cited

U.S. PATENT DOCUMENTS

| | | | | | |
|---|---|---|---|---|---|
| 4,481,379 | A | * | 11/1984 | Bolick et al. | 174/36 |
| 4,487,992 | A | * | 12/1984 | Tomita | 174/36 |
| 4,611,656 | A | * | 9/1986 | Kendall et al. | 166/65.1 |
| 4,924,037 | A | * | 5/1990 | Ainsworth et al. | 174/117 F |
| 5,084,594 | A | * | 1/1992 | Cady et al. | 174/36 |
| 5,569,050 | A | * | 10/1996 | Lloyd | 439/465 |
| 2001/0015282 | A1 | * | 8/2001 | Scantlebury | 174/117 F |
| 2002/0062979 | A1 | * | 5/2002 | Murakami et al. | 174/117 F |
| 2007/0095555 | A1 | * | 5/2007 | Venaleck | 174/75 C |
| 2007/0175652 | A1 | * | 8/2007 | Narumi | 174/117 F |
| 2008/0099226 | A1 | * | 5/2008 | Goch | 174/41 |
| 2009/0294149 | A1 | * | 12/2009 | Watanabe et al. | 174/102 R |
| 2010/0051314 | A1 | * | 3/2010 | Watanabe et al. | 174/102 R |
| 2010/0122831 | A1 | | 5/2010 | Watanabe | |
| 2012/0090866 | A1 | | 4/2012 | Gundel | |
| 2012/0090872 | A1 | | 4/2012 | Gundel | |
| 2012/0090873 | A1 | | 4/2012 | Gundel | |
| 2012/0097421 | A1 | | 4/2012 | Gundel | |
| 2013/0341063 | A1 | | 12/2013 | Gundel | |
| 2014/0116748 | A1 | | 5/2014 | Gundel | |

FOREIGN PATENT DOCUMENTS

| | | | |
|---|---|---|---|
| WO | WO 2009/025349 | A1 | 2/2009 |
| WO | WO 2009/148161 | A1 | 12/2009 |

* cited by examiner

SHIELDED FLAT RIBBON CABLE AND METHOD FOR FABRICATING A SHIELDED FLAT RIBBON CABLE

The present application is based on Japanese patent application No. 2011-094716 filed on Apr. 21, 2011, the entire contents of which are incorporated herein by reference.

BACKGROUND OF THE INVENTION

1. Field of the Invention

This invention relates to a shielded flat ribbon cable and a method for fabricating a shielded flat ribbon cable.

2. Description of the Related Art

Shielded flat ribbon cables are used within electronic equipment as wiring.

For example, Japanese Utility Model Laid-Open No. 63-127018 (JP-U 63-127018) discloses a shielded flat ribbon cable having a plurality of insulated wires comprising conductors and insulations coating the conductors respectively, in which the insulated wires are covered pair by pair with an individual shield layer and an electrically conductive polymeric resin. The pair of the insulated wires, the individual shield layer and the electrically conductive polymeric resin constitute an inner sheathed wire, and a plurality of the inner sheathed wires are covered with bundling (collective) insulating layers and bundling (collective) shielding layers.

Also, for example, JP-U 63-127018 shows in FIG. 3 a shielded flat ribbon cable as a prior art, in which one pair of insulated wires and an inner sheath covering these insulated wires constitute an inner sheathed wire. A plurality of the inner sheathed wires are disposed in parallel to each other with a spacing, and are covered with bundling shielding layers and bundling (collective) outer jackets. The bundling shielding layers form bridging portions between the adjacent inner sheathed wires, and the facing bundling shielding layers are in pressure contact with each other in the bridging portions.

On the other hand, as a transmission medium suitable for high frequency signal transmission, semi-rigid cables are also known. The semi-rigid cable has a copper pipe as an outer conductor, and an inner conductor and an insulation thereof are covered with the copper pipe.

The copper pipe of the semi-rigid cable is constant in inner diameter, and smooth in inner surface, and seamless in circumferential direction. For these reasons, the use of the semi-rigid cable lessens variation in characteristic impedance, so that it is easy to match load impedance, thereby suppressing the transmission loss, even when its skin effect is significant due to high frequency signal transmission.

SUMMARY OF THE INVENTION

In the shielded flat ribbon cable disclosed by JP-U 63-127018, the pair of the insulated wires are covered with the individual shield layer. Because the individual shield layer is formed of an aluminum-polyethylene laminated tape, the individual shield layer is soft, so that the distance between the conductors and the individual shield layer may vary.

Therefore, in this shielded flat ribbon cable, the variation in characteristic impedance tends to occur, and an impedance mismatch between the characteristic impedance and the load impedance tends to occur. Accordingly, there is a problem in that this shielded flat ribbon cable is not stable in high frequency properties.

Also, in the cable formed with the shield layer by wrapping the laminated tape, there is an inherent problem of the occurrence of a large disturbance called "suck out" in high frequency properties.

Further, in the conventional shielded flat ribbon cable disclosed in FIG. 3 of JP-U 63-127018, the bundling shielding layers are only in pressure contact with each other in the bridging portions.

Because the bundling shielding layers and the bundling outer jackets are formed of an aluminum-polyethylene laminated tape, they are soft, so that gaps are formed between the bundling shielding layers in the bridging portions. Accordingly, in this shielded flat ribbon cable, there is a problem in that the electromagnetic shielding properties are low in the bridging portions.

On the other hand, the semi-rigid cable using the copper pipe as the outer conductor has been known. However, since wiring the semi-rigid cables one by one is complicated, the semi-rigid cable is unsuitable for the wiring in the electronic equipment. Further, because the semi-rigid cable is manufactured by pushing the inner conductor and the insulation into the copper pipe, there is a problem in that the fabrication of the semi-rigid cable is not easy and the fabrication cost is high.

Accordingly, it is an object of the present invention to provide a shielded flat ribbon cable, which is excellent in high frequency properties and electromagnetic shielding properties, and easy to fabricate. Further, it is another object of the present invention to provide a method for fabricating a shielded flat ribbon cable.

(1) According to one embodiment of the invention, a shielded flat ribbon cable comprises:

a plurality of insulated conductors being spaced parallel to each other, the insulated conductors each including an inner conductor and an insulation coating the inner conductor;

an outer conductor bundling the insulated conductors together, the outer conductor including a first shell and a second shell in association with each other to sandwich the insulated conductors therebetween, each of the first shell and the second shell including a plurality of grooves covering outer surfaces of the insulated conductors, and a plurality of edge portions integral with both sides of the grooves; and gap formation-suppressing means for suppressing formation of gaps between the edge portions of the first shell and the edge portions of the second shell, respectively.

In one embodiment, the following modifications and changes can be made.

(i) Each of the first shell and the second shell comprises a molded metal sheet.

(ii) The gap formation-suppressing means includes solder layers provided between the edge portions of the first shell and the edge portions of the second shell.

(iii) The gap formation-suppressing means includes caulking portions having V transverse cross section shapes, formed by folding the edge portions of the first shell and the edge portions of the second shell.

(iv) The gap formation-suppressing means includes:

caulking holes formed in the edge portions of the first shell; and caulking portions formed in the edge portions of the second shell, the caulking portions being spread after being inserted in the caulking holes, respectively.

(v) The gap formation-suppressing means includes rivets passed through and attached to the edge portions of the first shell and the edge portions of the second shell.

(vi) The gap formation-suppressing means includes welded portions formed by welding the edge portions of the first shell and the edge portions of the second shell.

(vii) The gap formation-suppressing means includes electrically conductive adhesive layers provided between the edge portions of the first shell and the edge portions of the second shell.

(viii) Each of the insulated conductors includes two of the inner conductors.

(ix) Each of the insulated conductors has a transverse cross section shape of an ellipse, and a major axis direction of the ellipse matches a spacing direction of the inner conductors included in the insulated conductors and a spacing direction of the insulated conductors.

(2) According to another embodiment of the invention, a method for fabricating a shielded flat ribbon cable comprises:

preparing a plurality of insulated conductors spaced parallel to each other, the insulated conductors each including an inner conductor and an insulation coating the inner conductor;

preparing an outer conductor including a first shell and a second shell in association with each other to sandwich the conductors therebetween, each of the first shell and the second shell including a plurality of grooves covering outer surfaces of the insulated conductors, and a plurality of edge portions integral with both sides of the grooves;

preparing gap formation-suppressing means for suppressing formation of gaps between the edge portions of the first shell and the edge portions of the second shell, respectively;

arranging the insulated conductors between the first shell and the second shell; and after the arranging, fixing the first shell and the second shell together to bundle the insulated conductors together.

POINTS OF THE INVENTION

According to one embodiment of the invention, the gap formation-suppressing means is included, which prevents formation of gaps between the edge portions of the first shell and the edge portions of the second shell, respectively. The edge portions of the first shell and the edge portions of the second shell are then fixed together via the gap formation-suppressing means, and no gap exists between the edge portions of the first shell and the edge portions of the second shell, therefore ensuring excellent electromagnetic shielding properties. As a result, the crosstalk is then substantially suppressed to zero. Also, the shielded flat ribbon cable suppresses the transmission loss, even when its skin effect is significant due to the high frequency signal transmission. Thus, this shielded flat ribbon cable is excellent in the high frequency properties and electromagnetic shielding properties.

According to another embodiment of the invention, the shielded flat ribbon cable is easy to fabricate, and can be mass produced and supplied at low cost.

BRIEF DESCRIPTION OF THE DRAWINGS

The preferred embodiments according to the invention will be explained below referring to the appended drawings, wherein.

DETAILED DESCRIPTION OF THE PREFERRED EMBODIMENTS (First Embodiment)

Next, a first embodiment according to the invention will be explained in conjunction with the appended drawings.

Figure 1:
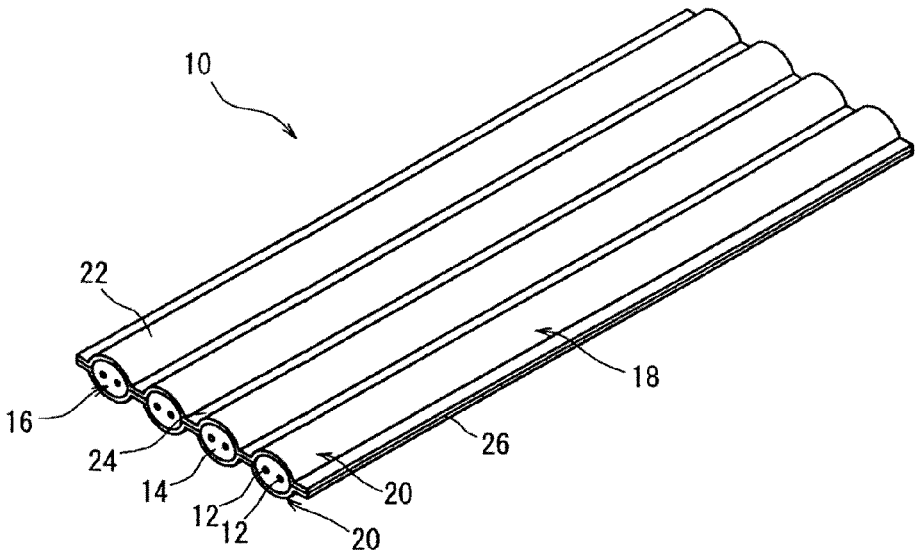
FIG. 1 is a schematic perspective view showing an appearance of a shielded flat ribbon cable in a first embodiment.
Figure 2:
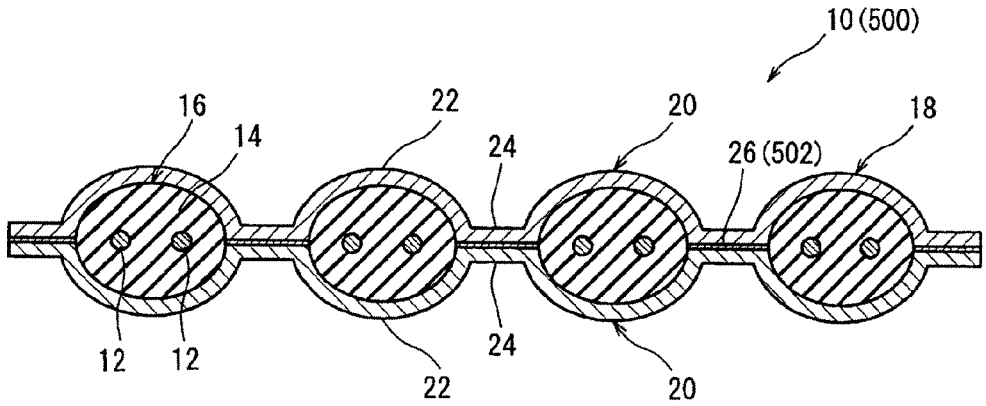
FIG. 2 is a schematic transverse cross sectional view showing the shielded flat ribbon cable in the first embodiment and a sixth embodiment.

FIG. 1 is a schematic perspective view showing an appearance of a shielded flat ribbon cable 10 in the first embodiment, and FIG. 2 is a schematic transverse cross sectional view of the shielded flat ribbon cable 10.

The shielded flat ribbon cable 10 is used as a wiring member for e.g. relay devices such as switching hubs or media converters, information processing devices such as servers or personal computers, and the like. For example, the shielded flat ribbon cable 10 is used for connection between ICs (integrated circuits) mounted on a printed circuit board, or between an IC and an interface. The shielded flat ribbon cable 10 is especially suitable for 10 Gbps or more high speed signal transmission.

(Shielded Flat Ribbon Cable 10)

As shown in FIGS. 1 and 2, the shielded flat ribbon cable 10 has a plurality of inner conductors 12. The inner conductors 12 are formed of a metal wire such as a copper wire. Outer surfaces of the inner conductors 12 are each insulated with an insulation 14. The insulation 14 is formed of e.g. a fluorine based resin such as polytetrafluoroethylene, polyethylene, foam of these materials, or the like.

In this embodiment, the shielded flat ribbon cable 10 is for differential signal transmission, and the twin inner conductors 12 disposed in parallel to each other with a spacing (i.e. spaced parallel to each other) are covered collectively (i.e. bundled together) with the single insulation 14. In the preferred embodiment, the insulation 14 is then shaped into an elliptic transverse cross section, and a major axis direction of the ellipse matches a spacing direction of the twin inner conductors 12.

Herein, the twin inner conductors 12, and the insulation 14 coating the twin inner conductors 12 are collectively referred to as a "insulated conductor 16".

The shielded flat ribbon cable 10 has a plurality of the insulated conductors 16, and in this embodiment, has four insulated conductors 16. The insulated conductors 16 are spaced parallel to each other.

Outer surfaces of the plural insulated conductors 16, i.e. the outer surfaces of the insulations 14 are covered collectively (i.e. bundled together) with an outer conductor 18. The outer conductor 18 is covered with two shells, i.e. a first shell 20 and a second shell 20 that are fixed to each other. The shells 20 are constructed of molded metal sheets (e.g. copper sheets) respectively.

Each of the shells 20 is molded by e.g. press molding, and has a thickness of not less than 100 μm and not more than 500 μm. Accordingly, the shielded flat ribbon cable 10 is a semi-rigid cable which is to some extent flexible. It should be noted, however, that the upper limit of 500 μm is a rough estimate, and the thickness can exceed this upper limit according to applications or frequencies to be used.

Each of the shells 20 has a plurality of semi-elliptic grooves 22 corresponding to the number of the insulated conductors 16, and a plurality of edge portions 24 that are integral (i.e. in one body) with both sides of the grooves 22.

A curvature of inner surfaces of the grooves 22 is matched to a curvature of the outer surfaces of the insulated conductors 16, and the inner surfaces of the grooves 22 are shaped into a semi-elliptic transverse cross section. The inner surfaces of the grooves 22 are in close contact with the outer surfaces of the insulated conductors 16, respectively.

It is preferred that a major axis direction of the semi-ellipse of the grooves 22 matches a spacing direction of the insulated conductors 16. According to this structure, the spacing direction of the inner conductors 12 in each insulated conductor 16 matches the spacing direction of the insulated conductors 16.

On the other hand, the edge portions 24 of the two shells 20 are each flat and configured to face each other. In this embodiment, the facing edge portions 24 are then fixed to each other with solder layers 26, respectively. The solder layers 26 constitute a gap formation-suppressing means for suppressing formation of gaps in which no electrically conductive material exists between the facing edge portions 24.

It is preferred that the solder layers 26 be provided and no gap exists in a longitudinal direction of the facing edge portions 24.

(Method for Fabricating a Shielded Flat Ribbon Cable 10)

Next, a method for fabricating the above described shielded flat ribbon cable 10 is described below.

Figure 3:
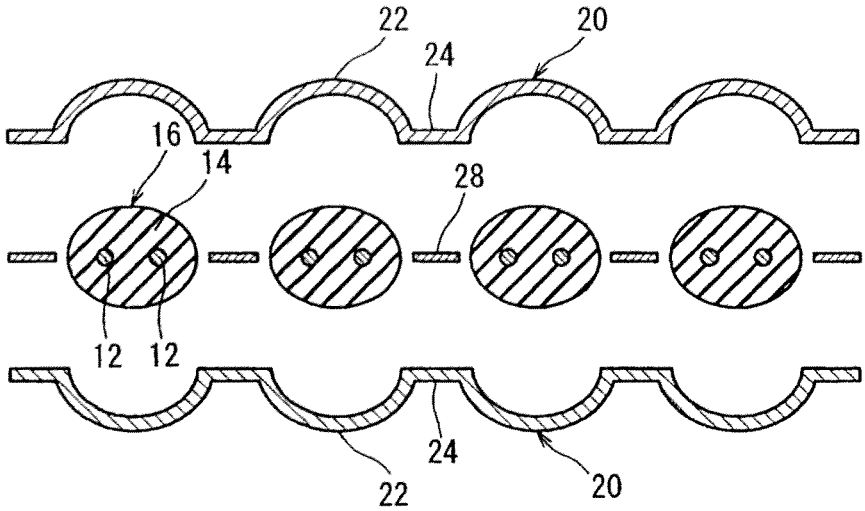
FIG. 3 is a transverse cross sectional view showing parts used in fabrication of the shielded flat ribbon cable of FIG. 1.

Referring first to FIG. 3, parts are prepared. That is, the two shells 20 are prepared by metal sheet press molding. On the other hand, the insulated conductors 16 are prepared by extrusion molding of the insulation 14 to coat the twin inner conductors 12. Also, as a material for the solder layers 26, a ribbon solder 28 is prepared.

Figure 4:
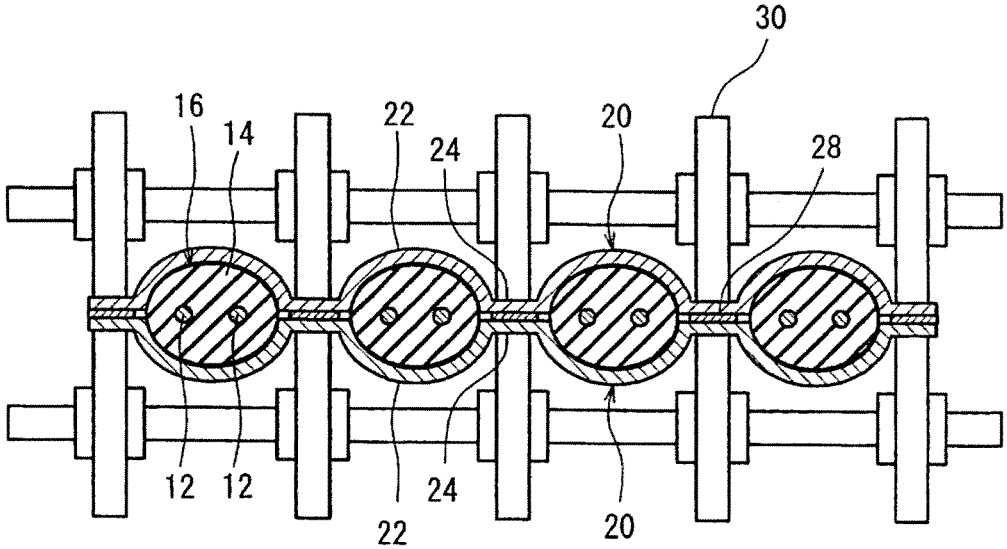
FIG. 4 is a diagram showing fixing shells together by using rollers and melting solder in the fabrication of the shielded flat ribbon cable of FIG. 1.

Referring then to FIG. 4, the insulated conductors 16 and the solder 28 are arranged to be sandwiched between the shells 20. In this arrangement, the facing edge portions 24 are sandwiched between two heated high temperature rollers 30 and pressed from outside by them, and then the rollers 30 are moved relatively over an entire length of the facing edge portions 24. This allows the solder 28 to melt and form the solder layers 26, and fix the facing edge portions 24 together via the solder layers 26, respectively.

Incidentally, the shielded flat ribbon cables 10 may be fabricated not one by one, but continuously. That is, the shielded flat ribbon cables 10 may be fabricated by continuously sending such parts as the shells 20, the insulated conductors 16 and the solder 28, heating them with the rollers 30 to make them integral with each other, and then cutting the integral parts. Alternatively, the integral parts may be rolled up, and shipped as a roll of the shielded flat ribbon cables 10.

Also, the ribbon solder 28 may be replaced by preforming solder plating layers to the edge portions 24 respectively, heating and changing the solder plating layers into the solder layers 26.

According to the shielded flat ribbon cable 10 in the above described first embodiment, the shells 20 are formed of the metal, therefore allowing high precision shape molding of the grooves 22, and stable shape holding of the molded grooves 22. Also, the shells 20 are formed of the metal, therefore ensuring the smoothness of the inner surfaces of the grooves 22.

(Advantages)

As a result, the shielded flat ribbon cable 10 is stable in the characteristic impedance, therefore easily ensuring the impedance matching between the characteristic impedance and the load impedance. Also, the shielded flat ribbon cable 10 therefore suppresses the transmission loss, even when its skin effect is significant due to the high frequency signal transmission.

In this shielded flat ribbon cable 10, the facing edge portions 24 are then fixed together via the electrically conductive solder layers 26 respectively, and no gap exists between the facing edge portions 24, therefore ensuring excellent electromagnetic shielding properties. As a result, the crosstalk is substantially suppressed to zero.

Further, the two shells 20 always have the same electric potentials in the high frequency region as well, therefore being not likely to cause property degradation, even if the dimensions of the insulated conductors 16 deviate from ideal values.

Thus, this shielded flat ribbon cable 10 is excellent in the high frequency properties and electromagnetic shielding properties.

Incidentally, the gap formation-suppressing means may permit a narrow gap to form between the facing edge portions 24, as long as the electromagnetic shielding properties do not worsen.

On the other hand, in the fabrication of this shielded flat ribbon cable 10, the shells 20 are easily obtained by metal sheet press molding. Also, the facing edge portions 24 can easily be fixed together via the solder layers 26 respectively, by using the ribbon solder 28 and being heated with the high temperature rollers 30. This shielded flat ribbon cable 10 is therefore easy to fabricate, and can be mass produced and supplied at low cost.

The shielded flat ribbon cable 10 includes the plural insulated conductors 16. The use of this shielded flat ribbon cable 10 therefore allows batch termination to peel the outer conductor 18 and the insulations 14 to expose the inner conductors 12, and batch connection of the exposed inner conductors 12 to a corresponding connector or the like. For this reason, the use of this shielded flat ribbon cable 10 facilitates its termination and connection to the connector or the like, in comparison to using the conventional semi-rigid cables one by one.

(Second Embodiment)

Next, the second embodiment will be explained below. Incidentally, in the embodiments description below, elements the same as or similar to those of the preceding embodiment are given the same names or numerals, and detailed descriptions thereof are omitted.

(Shielded Flat Ribbon Cable 100)

Figure 5:
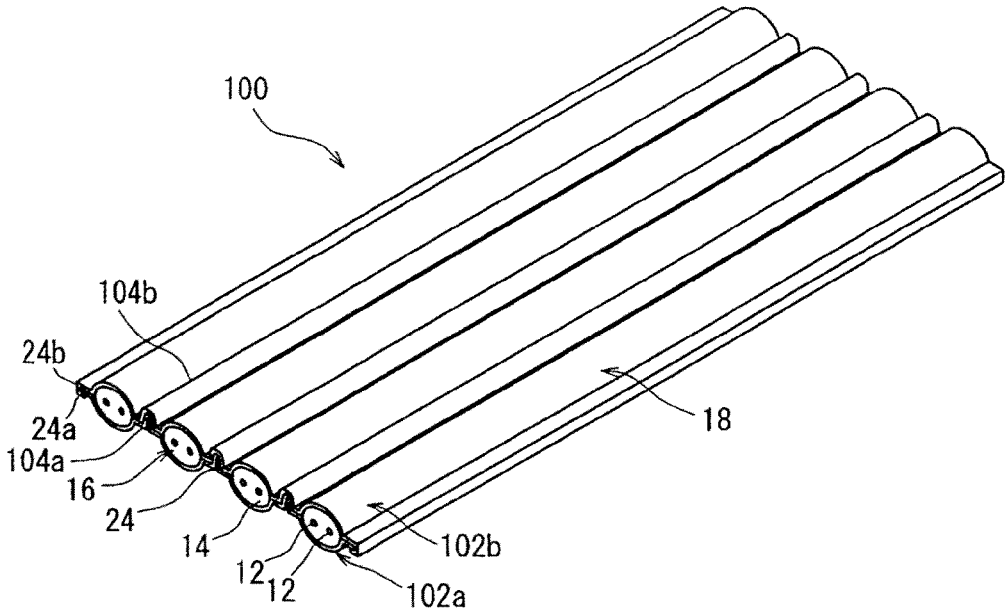
FIG. 5 is a schematic perspective view showing an appearance of a shielded flat ribbon cable in a second embodiment.
Figure 6:
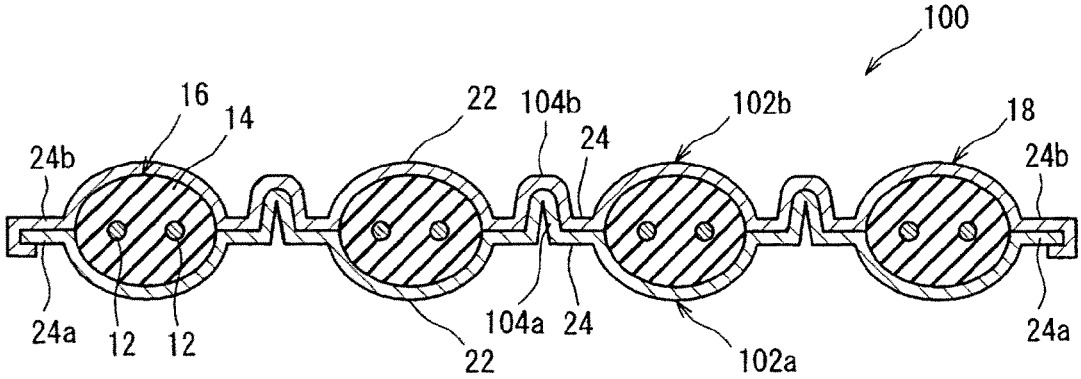
FIG. 6 is a schematic transverse cross sectional view showing the shielded flat ribbon cable of FIG. 5.

FIG. 5 is a schematic perspective view showing an appearance of a shielded flat ribbon cable 100 in the second embodiment, and FIG. 6 is a schematic transverse cross sectional view of the shielded flat ribbon cable 100.

The shielded flat ribbon cable 100 differs from the shielded flat ribbon cable 10 in that it has no solder layers 26, but is further provided with caulking portions 104*a* and 104*b* in the edge portions 24.

The caulking portions 104*a* and 104*b* project from the edge portions 24 toward one side in a direction of superimposing two shells 102*a* and 102*b*. The caulking portions 104*a* have a V transverse cross section shape, and the caulking portions 104*b* have a substantially V transverse cross section shape similar to the caulking portions 104*a*. The caulking portions 104*b* hold the caulking portions 104*a* in substantially V shaped portions, respectively, and are in close contact with the caulking portions 104*a* respectively.

Also, the caulking portions 104*a* and 104*b* extend along the insulated conductors 16, respectively, in a longitudinal direction of the edge portions 24, from end to end of the shielded flat ribbon cable 100.

On the other hand, of the shells 102*a* and 102*b*, one shell 102*b* has flat portions 24*b* located on both sides of the shielded flat ribbon cable 100 and molded to be wider than edge portions 24*a* on both sides of the other shell 102*a*. The wide edge portions 24*b* on both sides of one shell 102*b* are then folded substantially 180 degrees back to cover side edges of the edge portions 24*a* on both the sides of the other shell 102*a*.

(Method for Fabricating the Shielded Flat Ribbon Cable 100)

A method for fabricating the above described shielded flat ribbon cable 100 in the second embodiment differs from the first embodiment in the manner of fixing the two shells 102*a* and 102*b*. That is, in the method of fabricating the shielded flat ribbon cable 100, the caulking portions 104*a* are placed in the substantially V shaped portions of the caulking portions 104*b* respectively, and the caulking portions 104*b* are compressed, so that the caulking portions 104*a* and 104*b* are fixed together in close contact with each other.

The edge portions 24*b* on both the sides of one shell 102*b* are then folded, so that the edge portions 24*a* on both the sides of the other shell 102*a* and the edge portions 24*b* on both the sides of one shell 102*b* are fixed together in close contact with each other.

That is, the caulking portions 104*a* and 104*b* constitute a gap formation-suppressing means between the insulated conductors 16, and the folded edge portions 24*b* on both the sides of one shell 102*b* constitute a gap formation-suppressing means on both the sides of the shielded flat ribbon cable 100.

(Advantages)

Similarly to the shielded flat ribbon cable 10, the above described shielded flat ribbon cable 100 in the second embodiment stabilizes its characteristic impedance, therefore easily ensuring the impedance matching between the characteristic impedance and the load impedance. Also, the shielded flat ribbon cable 100 therefore suppresses the transmission loss, even when its skin effect is significant due to the high frequency signal transmission.

Also, with this shielded flat ribbon cable 100, the caulking portions 104*b* are fixed in close contact with the caulking portions 104*a* between the insulated conductors 16, and no gap exists between the caulking portions 104*a* and 104*b*. Also, on both the sides of the shielded flat ribbon cable 100, the edge portions 24*b* on both the sides of one shell 102*b* are then fixed in close contact with the edge portions 24*a* on both the sides of the other shell 102*a*, and no gap exists between the edge portions 24*a* and 24*b* on both the sides of the shells 102*a* and 102*b*. As a result, this shielded flat ribbon cable 100 ensures the excellent electromagnetic shielding properties. Accordingly, the crosstalk is substantially suppressed to zero.

Further, the two shells 102*a* and 102*b* always have the same electric potentials in the high frequency region as well, therefore being not likely to cause property degradation, even if the dimensions of the insulated conductors 16 deviate from the ideal values.

On the other hand, in the fabrication of this shielded flat ribbon cable 100, the shells 102*a* and 102*b* are easily obtained by the metal sheet press molding. Also, the caulking portions 104*a* and 104*b* of the shells 102*a* and 102*b* can easily be fixed together by compressing the caulking portions 104*b*, and the edge portions 24*a* and 24*b* on both the sides of the shells 102*a* and 102*b* can easily be fixed together by folding the edge portions 24*b* on both the sides of one shell 102*b*. This shielded flat ribbon cable 100 is therefore easy to fabricate, and can be mass produced and supplied at low cost.

The use of this shielded flat ribbon cable 100 then facilitates its termination and connection, similarly to the shielded flat ribbon cable 10.

(Third Embodiment)

Next, the third embodiment will be explained below.

(Shielded Flat Ribbon Cable 200)

Figure 7:
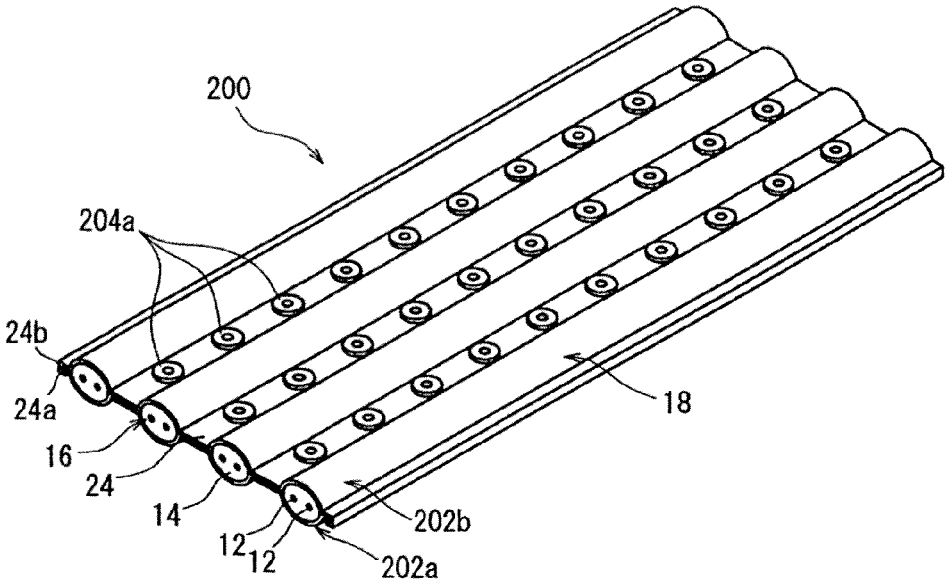
FIG. 7 is a schematic perspective view showing an appearance of a shielded flat ribbon cable in a third embodiment.
Figure 8:
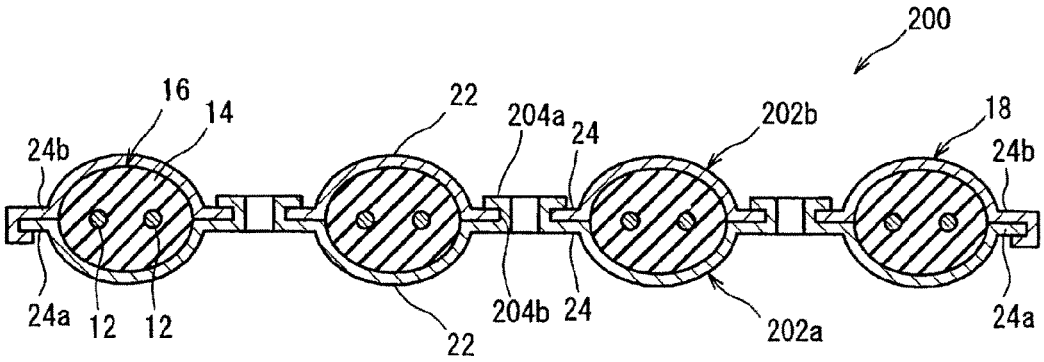
FIG. 8 is a schematic transverse cross sectional view showing the shielded flat ribbon cable of FIG. 7.

FIG. 7 is a schematic perspective view showing an appearance of a shielded flat ribbon cable 200 in the third embodiment, and FIG. 8 is a schematic transverse cross sectional view of the shielded flat ribbon cable 200.

The shielded flat ribbon cable 200 differs from the shielded flat ribbon cable 100 in that one shell 202*b* has caulking holes 204*b* in its edge portions 24 respectively, while an other shell 202*a* has caulking portions 204*a* which engage circumferential edges of the caulking holes 204*b* respectively.

More specifically, the edge portions 24 of one shell 202*b* are formed with a plurality of the caulking holes 204*b* respectively spaced apart in a longitudinal direction thereof. The other shell 202*a* is then provided with a plurality of the caulking portions 204*a* that are located in correspondence with the caulking holes 204*b* respectively.

The caulking portions 204*a* project from the edge portions 24 toward the superimposed shell 202*b*, and are inserted in the caulking holes 204*b* respectively from one side. The caulking portions 204*a* are spread on an opposite side of the caulking holes 204*b* respectively, and are in association with the edge portions 24 of the shells 202*a* and 202*b* respectively, to hold the circumferential edges of the caulking holes 204*b* respectively. By holding the circumferential edges of the caulking holes 204*b* with the caulking portions 204*a* and the edge portions 24 of the shells 202*a* and 202*b*, the edge portions 24 of the two shells 202*a* and 202*b* are fixed together in close contact with each other between the insulated conductors 16.

(Method for Fabricating the Shielded Flat Ribbon Cable 200)

A method for fabricating the above described shielded flat ribbon cable 200 in the third embodiment differs from the second embodiment in the manner of fixing the two shells 202*a* and 202*b*. That is, in the method for fabricating the shielded flat ribbon cable 200, the caulking portions 204*a* having a cylindrical shape prior to caulking are inserted into the caulking holes 204*b* respectively, and then tips of the caulking portions 204*a* are each compressed to spread.

According to this structure, the spread caulking portions 204*a* and the edge portions 24 of the shells 202*a* and 202*b* hold the circumferential edges of the caulking holes 204*b* respectively, thereby allowing the edge portions 24 of the two shells 202*a* and 202*b* to be fixed together in close contact with each other.

That is, the caulking holes 204*b* and the caulking portions 204*a* constitute a gap formation-suppressing means between the insulated conductors 16.

(Advantages)

Similarly to the shielded flat ribbon cable 10, the above described shielded flat ribbon cable 200 in the third embodiment stabilizes its characteristic impedance, therefore easily ensuring the impedance matching between the characteristic impedance and the load impedance. Also, the shielded flat ribbon cable 200 therefore suppresses the transmission loss, even when its skin effect is significant due to the high frequency signal transmission.

Also, according to this shielded flat ribbon cable 200, the caulking holes 204*b* and the caulking portions 204*a* allow the edge portions 24 of the two shells 202*a* and 202*b* to be fixed together in close contact with each other between the insulated conductors 16, and no gap exists between the edge portions 24 of the two shells 202*a* and 202*b*. Also, the edge portions 24*b* on both the sides of one shell 202*b* are then fixed in close contact with the edge portions 24*a* on both the sides of the other shell 202*a* on both the sides of the shielded flat ribbon cable 200, and no gap exists between the edge portions 24*a* and 24*b* on both the sides of the shells 202*a* and 202*b*. As a result, this shielded flat ribbon cable 200 ensures the excellent electromagnetic shielding properties. As a result, the crosstalk is substantially suppressed to zero.

Further, the two shells 202*a* and 202*b* always have the same electric potentials in the high frequency region as well, therefore being not likely to cause the property degradation, even if the dimensions of the insulated conductors 16 deviate from the ideal values.

On the other hand, in the fabrication of this shielded flat ribbon cable 200, the shells 202*a* and 202*b* are easily obtained by the metal sheet press molding. Also, the edge portions 24 of the shells 202*a* and 202*b* can easily be fixed together by compressing the caulking portions 204*a*, and folding the edge portions 24*b* on both the sides of one shell 202*b*. This shielded flat ribbon cable 200 is therefore easy to fabricate, and can be mass produced and supplied at low cost.

The use of this shielded flat ribbon cable 200 facilitates its termination and connection, similarly to the shielded flat ribbon cable 10.

(Fourth Embodiment)

Next, the fourth embodiment will be explained below.

(Shielded Flat Ribbon Cable 300)

Figure 9:
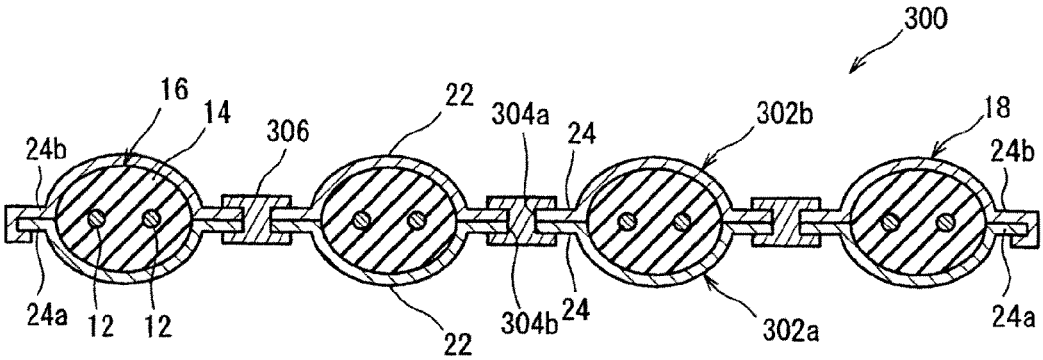
FIG. 9 is a schematic transverse cross sectional view showing a shielded flat ribbon cable in a fourth embodiment.

FIG. 9 is a schematic transverse cross sectional view showing a shielded flat ribbon cable 300 in the fourth embodiment.

The shielded flat ribbon cable 300 is provided with rivet holes 304*a* and 304*b* in shells 302*a* and 302*b*, and rivets 306 passed through the rivet holes 304*a* and 304*b* and attached to the edge portions 24 of the shells 302*a* and 302*b*.

(Method for Fabricating the Shielded Flat Ribbon Cable 300)

In the fabrication of the shielded flat ribbon cable 300, the rivets 306 before being collapsed may be inserted in the rivet holes 304*a* and 304*b*, and may then be collapsed. Incidentally, a plurality of the rivets 306 are attached in such a manner as to be spaced appropriately apart in a longitudinal direction of the edge portions 24.

(Advantages)

Similarly to the shielded flat ribbon cable 10, the above described shielded flat ribbon cable 300 in the fourth embodiment stabilizes its characteristic impedance, therefore easily ensuring impedance matching between the characteristic impedance and the load impedance. Also, the shielded flat ribbon cable 300 therefore suppresses the transmission loss, even when its skin effect is significant due to the high frequency signal transmission.

Also, with this shielded flat ribbon cable 300, the rivet holes 304*a* and 304*b* and the rivets 306 allow the edge portions 24 of the two shells 302*a* and 302*b* to be fixed together in close contact with each other between the insulated conductors 16, and no gap exists between the edge portions 24 of the two shells 302*a* and 302*b*. Also, the edge portions 24*b* on both the sides of one shell 302*b* are then fixed in close contact with the edge portions 24*a* on both the sides of the other shell 302*a* on both the sides of the shielded flat ribbon cable 300, and no gap exists between the edge portions 24*a* and 24*b* on both the sides of the shells 302*a* and 302*b*. As a result, this shielded flat ribbon cable 300 ensures the excellent electromagnetic shielding properties. As a result, the crosstalk is substantially suppressed to zero.

Further, the two shells 302*a* and 302*b* always have the same electric potentials in the high frequency region as well, therefore being not likely to cause the property degradation, even if the dimensions of the insulated conductors 16 deviate from the ideal values.

On the other hand, in the fabrication of this shielded flat ribbon cable 300, the shells 302*a* and 302*b* are easily obtained by the metal sheet press molding. Also, the edge portions 24 of the shells 302*a* and 302*b* can easily be fixed together by collapsing the rivets 306, and folding the edge portions 24*b* on both the sides of one shell 302*b*. This shielded flat ribbon cable 300 is therefore easy to fabricate, and can be mass produced and supplied at low cost.

The use of this shielded flat ribbon cable 300 facilitates its termination and connection, similarly to the shielded flat ribbon cable 10.

(Fifth Embodiment)

Next, the fifth embodiment will be explained below.

(Shielded Flat Ribbon Cable 400)

Figure 10:
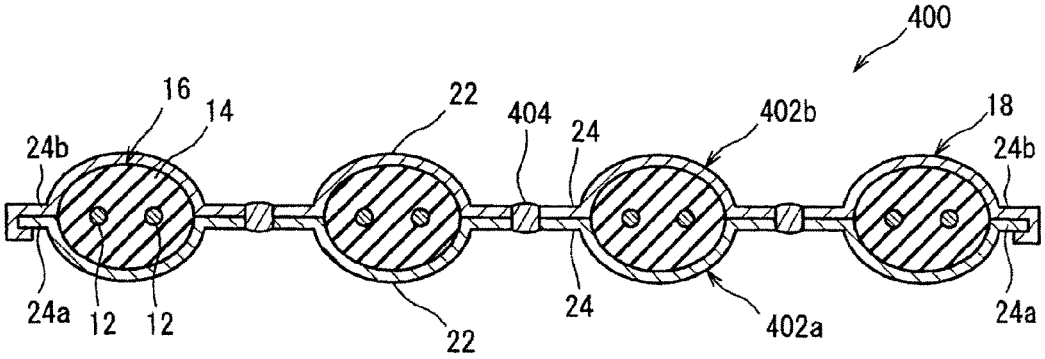
FIG. 10 is a schematic transverse cross sectional view showing a shielded flat ribbon cable in a fifth embodiment.

FIG. 10 is a schematic transverse cross sectional view showing a shielded flat ribbon cable 400 in the fifth embodiment.

In the shielded flat ribbon cable 400, the edge portions 24 of shells 402*a* and 402*b* are welded together, so that the edge portions 24 thereof are fixed together by welded portions 404 respectively formed by welding. That is, the welded portions 404 constitute a gap formation-suppressing means.

(Method for Fabricating the Shielded Flat Ribbon Cable 400)

In the fabrication of the shielded flat ribbon cable 400, the superimposed edge portions 24 of shells 402*a* and 402*b* may be welded together.

The welding method may use e.g. laser welding, electric spot welding or electric resistance welding, but the laser welding is preferred to weld the edge portions 24 in an entire longitudinal direction thereof.

(Advantages)

Similarly to the shielded flat ribbon cable 10, the above described shielded flat ribbon cable 400 in the fifth embodiment stabilizes its characteristic impedance, therefore easily ensuring impedance matching between the characteristic impedance and the load impedance. Also, the shielded flat ribbon cable 400 therefore suppresses the transmission loss, even when its skin effect is significant due to the high frequency signal transmission.

Also, with this shielded flat ribbon cable 400, the welded portions 404 allow the edge portions 24 of the two shells 402*a* and 402*b* to be fixed together in close contact with each other between the insulated conductors 16, and no gap exists between the edge portions 24 of the two shells 402*a* and 402*b*. Also, the edge portions 24*b* on both the sides of one shell 402*b* are then fixed in close contact with the edge portions 24*a* on both the sides of the other shell 402*a* on both the sides of the shielded flat ribbon cable 400, and no gap exists between the edge portions 24*a* and 24*b* on both the sides of the shells 402*a* and 402*b*. As a result, this shielded flat ribbon cable 400 ensures the excellent electromagnetic shielding properties. As a result, the crosstalk is substantially suppressed to zero.

Further, the two shells 402*a* and 402*b* always have the same electric potentials in the high frequency region as well, therefore being not likely to cause the property degradation, even if the dimensions of the insulated conductors 16 deviate from the ideal values.

On the other hand, in the fabrication of this shielded flat ribbon cable 400, the shells 402*a* and 402*b* are easily obtained by the metal sheet press molding. Also, the edge portions 24 of the shells 402*a* and 402*b* can easily be fixed together by the welding. This shielded flat ribbon cable 400 is therefore easy to fabricate, and can be mass produced and supplied at low cost.

The use of this shielded flat ribbon cable 400 facilitates its termination and connection, similarly to the shielded flat ribbon cable 10.

(Sixth Embodiment)

The sixth embodiment will be explained below.

(Shielded Flat Ribbon Cable 500)

FIG. 2 also shows the schematic transverse cross section of a shielded flat ribbon cable 500 in the sixth embodiment.

In the shielded flat ribbon cable 500, the edge portions 24 of the two shells 20 are fixed together, via electrically conductive adhesive layers 502, in place of the solder layers 26.

(The Method for Fabricating the Shielded Flat Ribbon Cable 500)

In the fabrication of the shielded flat ribbon cable 500, an electrically conductive adhesive is applied to the edge portions 24, and then the edge portions 24 of the two shells 20 are superimposed, and are heated if desired, to harden the electrically conductive adhesive.

(Advantages)

Similarly to the shielded flat ribbon cable 10, the above described shielded flat ribbon cable 500 in the sixth embodiment stabilizes its characteristic impedance, therefore easily ensuring impedance matching between the characteristic impedance and the load impedance. Also, the shielded flat ribbon cable 500 suppresses the transmission loss, even when its skin effect is significant due to the high frequency signal transmission.

Also, with this shielded flat ribbon cable 500, the edge portions 24 of the two shells 20 are fixed together in close contact with each other via the electrically conductive adhesive layers 502 respectively, and no gap exists between the edge portions 24 of the two shells 20. Consequently, this shielded flat ribbon cable 500 ensures the excellent electromagnetic shielding properties. As a result, the crosstalk is then substantially suppressed to zero.

Further, the two shells 20 always have the same electric potentials in the high frequency region as well, therefore being not likely to cause the property degradation, even if the dimensions of the insulated conductors 16 deviate from the ideal values.

On the other hand, in the fabrication of this shielded flat ribbon cable 500, the shells 20 are easily obtained by the metal sheet press molding. Also, the edge portions 24 of the two shells 20 can easily be fixed together by the welding. This shielded flat ribbon cable 500 is therefore easy to fabricate, and can be mass produced and supplied at low cost.

The use of this shielded flat ribbon cable 500 facilitates its termination and connection, similarly to the shielded flat ribbon cable 10.

(Seventh Embodiment)

Next, the seventh embodiment will be explained below.

(Shielded Flat Ribbon Cable 600)

Figure 11:
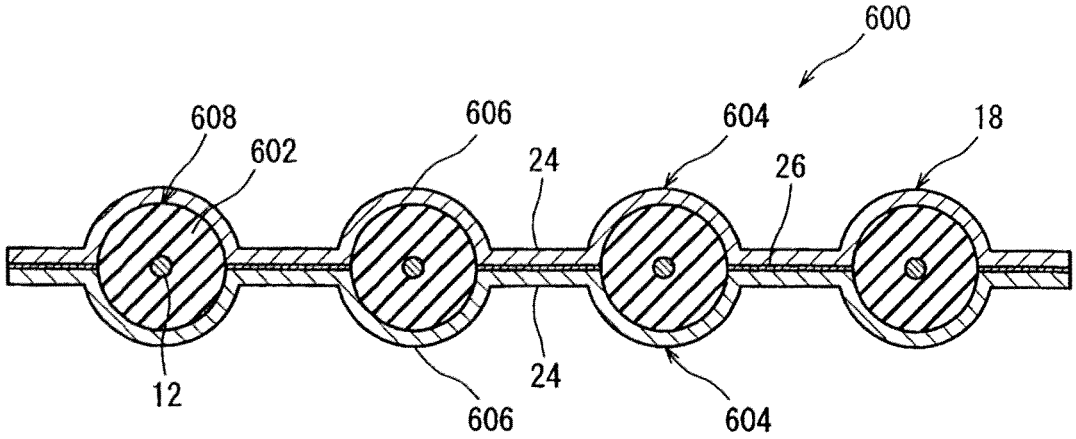
FIG. 11 is a schematic transverse cross sectional view showing a shielded flat ribbon cable in a seventh embodiment.

FIG. 11 is a schematic transverse cross sectional view showing a shielded flat ribbon cable 600 in the seventh embodiment. In the shielded flat ribbon cable 600, the single inner conductor 12 is insulated with a single insulation 602. That is, the shielded flat ribbon cable 600 is applied for non-differential signal transmission.

The insulation 602 is shaped into a circular transverse cross section, and grooves 606 of shells 604 are shaped into a semi-circular transverse cross section. A radius of inner surfaces of the grooves 606 is matched to a radius of an outer surface of the insulation 602, so that the inner surfaces of the grooves 606 are in close contact with the outer surface of the insulation 602.

The shielded flat ribbon cable 600 in the seventh embodiment may be fabricated with the same method as that of the shielded flat ribbon cable 10 in the first embodiment, except the use of insulated conductors 608 formed of the inner conductor 12 and the insulation 602, and the shielded flat ribbon cable 600 has the same advantages as the shielded flat ribbon cable 10.

The invention is not limited to the above described first to seventh embodiments, but also embodies alterations thereto and appropriate combinations thereof.

For example, in the above described first to seventh embodiments, each of the shielded flat ribbon cables 10, 100, 200, 300, 400, 500, and 600 includes the four insulated conductors 16 or 608, but may include at least two insulated conductors 16 or 608.

In the above described first to sixth embodiments, the insulations 14 are shaped into the elliptic transverse cross section, but may be shaped into a circular transverse cross section. It should be noted, however, that in this case, it is preferred to provide an aligning means for aligning the spacing direction of the twin inner conductors 12 in a constant direction relative to the spacing direction of the insulated conductors 16. As the aligning means, recesses and protrusions, for instances, which are engaged with each other, may be provided for the insulations 14 and the outer conductor 18, respectively.

Also, in the above described first to seventh embodiments, the inner surfaces of the grooves 22 or 606 may be plated, in order to enhance the smoothness thereof.

Finally, the shielded flat ribbon cables according to the invention may naturally also be applied to the electronic equipments other than the relay devices and the information processing devices.

Although the invention has been described, the invention according to claims is not to be limited by the above-mentioned embodiments and examples. Further, please note that not all combinations of the features described in the embodiments and the examples are not necessary to solve the problem of the invention.

What is claimed is:

1. A shielded flat ribbon cable, comprising:

a plurality of insulated conductors being spaced parallel to each other, the insulated conductors each including an inner conductor and an insulation coating the inner conductor;

an outer conductor bundling the insulated conductors together, the outer conductor including a first shell and a second shell in association with each other to sandwich the insulated conductors therebetween, each of the first shell and the second shell including a plurality of grooves covering outer surfaces of the insulated conductors, and a plurality of edge portions integral with both sides of the grooves; and gap formation-suppressing means for suppressing formation of gaps between the edge portions of the first shell and the edge portions of the second shell, respectively, wherein each of the first shell and the second shell comprises a molded metal sheet, and wherein the gap formation-suppressing means includes caulking portions having V transverse cross section shapes, formed by folding the edge portions of the first shell and the edge portions of the second shell.

2. A shielded flat ribbon cable, comprising:

a plurality of insulated conductors being spaced parallel to each other, the insulated conductors each including an inner conductor and an insulation coating the inner conductor;

an outer conductor bundling the insulated conductors together, the outer conductor including a first shell and a second shell in association with each other to sandwich the insulated conductors therebetween, each of the first shell and the second shell including grooves covering outer surfaces of the insulated conductors, and a plurality of edge portions integral with both sides of the grooves, each of the first shell and the second shell comprising a molded metal sheet; and gap formation-suppressing means for suppressing formation of gaps between the edge portions of the first shell and the edge portions of the second shell, respectively, wherein each of the insulated conductors comprises a transverse cross section shape of an ellipse, a major axis direction of the ellipse overlaps a spacing direction of the inner conductors included in the insulated conductors and a spacing direction of the insulated conductors, and a minor axis of the ellipse is shorter than a major axis of the ellipse, and wherein inner surfaces of the grooves are shaped into a transverse cross section of a semi-ellipse and are in close contact with the outer surfaces of the insulated conductors, respectively, and a major axis direction of the semi-ellipse of the grooves overlaps the spacing direction of the insulated conductors.

3. The shielded flat ribbon cable according to claim 2, wherein the gap formation-suppressing means includes solder layers provided between the edge portions of the first shell and the edge portions of the second shell.

4. The shielded flat ribbon cable according to claim 2, wherein the gap formation-suppressing means includes:

caulking holes formed in the edge portions of the first shell; and caulking portions formed in the edge portions of the second shell, the caulking portions being spread after being inserted in the caulking holes, respectively.

5. The shielded flat ribbon cable according to claim 2, wherein the gap formation-suppressing means includes rivets passed through and attached to the edge portions of the first shell and the edge portions of the second shell.

6. The shielded flat ribbon cable according to claim 2, wherein the gap formation-suppressing means includes welded portions formed by welding the edge portions of the first shell and the edge portions of the second shell.

7. The shielded flat ribbon cable according to claim 2, wherein the gap formation-suppressing means includes electrically conductive adhesive layers provided between the edge portions of the first shell and the edge portions of the second shell.

8. The shielded flat ribbon cable according to claim 2, wherein each of the insulated conductors includes two of the inner conductors.

9. The shielded flat ribbon cable according to claim 2, wherein the gap formation-suppressing means includes caulking portions having transverse cross section shapes, formed by folding the edge portions of the first shell and the edge portions of the second shell.

10. The shielded flat ribbon cable according to claim 2, wherein the gap formation-suppressing means includes caulking portions having V transverse cross section shapes.

11. The shielded flat ribbon cable according to claim 10, wherein the gap formation-suppressing means includes:

caulking holes formed in the edge portions of the first shell.

12. The shielded flat ribbon cable according to claim 2, wherein the gap formation-suppressing means further includes:

caulking portions formed in the edge portions of the second shell.

13. A method for fabricating a shielded flat ribbon cable, said method comprising:

preparing a plurality of insulated conductors spaced parallel to each other, the insulated conductors each including an inner conductor and an insulation coating the inner conductor;

preparing an outer conductor including a first shell and a second shell in association with each other to sandwich the conductors therebetween, each of the first shell and the second shell including grooves covering outer surfaces of the insulated conductors, and a plurality of edge portions integral with both sides of the grooves, each of the first shell and the second shell comprising a molded metal sheet;

preparing gap formation-suppressing means for suppressing formation of gaps between the edge portions of the first shell and the edge portions of the second shell, respectively;

arranging the insulated conductors between the first shell and the second shell; and after the arranging, fixing the first shell and the second shell together to bundle the insulated conductors together, wherein each of the insulated conductors comprises a transverse cross section shape of an ellipse, a major axis direction of the ellipse overlaps a spacing direction of the inner conductors included in the insulated conductors and a spacing direction of the insulated conductors, and a minor axis of the ellipse is shorter than a major axis of the ellipse, and wherein inner surfaces of the grooves are shaped into a transverse cross section of a semi-ellipse and are in close contact with the outer surfaces of the insulated conductors, respectively, and a major axis direction of the semi-ellipse of the grooves overlaps the spacing direction of the insulated conductors.

14. The method according to claim 13, wherein the gap formation-suppressing means includes caulking portions having transverse cross section shapes, formed by folding the edge portions of the first shell and the edge portions of the second shell.

15. The method according to claim 13, wherein the gap formation-suppressing means includes caulking portions having V transverse cross section shapes.

16. The method according to claim 13, wherein the gap formation-suppressing means includes caulking portions having V transverse cross section shapes, formed by folding the edge portions of the first shell and the edge portions of the second shell.

17. The method according to claim 13, wherein the gap formation-suppressing means includes:

caulking holes formed in the edge portions of the first shell.

18. The method according to claim 17, wherein the gap formation-suppressing means further includes:

caulking portions formed in the edge portions of the second shell.

* * * * *